US011841127B1

(12) United States Patent
Sun et al.

(10) Patent No.: US 11,841,127 B1
(45) Date of Patent: Dec. 12, 2023

(54) PROJECTION LAMP WITH QUICK LOCKING AND SELF-DETECTION FUNCTIONS

(71) Applicant: Anhui Guangju Bozhong electronic technology Co., LTD, Wuhu (CN)

(72) Inventors: Ziqiang Sun, Wuhu (CN); Jinhua Zhang, Wuhu (CN); Yuan Chang, Wuhu (CN)

(73) Assignee: ANHUI GUANGJU BOZHONG ELECTRONIC TECHNOLOGY CO LTD, Wuhu (CN)

( * ) Notice: Subject to any disclaimer, the term of this patent is extended or adjusted under 35 U.S.C. 154(b) by 0 days.

(21) Appl. No.: 18/359,019

(22) Filed: Jul. 26, 2023

(30) Foreign Application Priority Data

Jun. 20, 2023 (CN) ..... 2020310732705.1

(51) Int. Cl.
*F21V 15/01* (2006.01)

(52) U.S. Cl.
CPC ..... *F21V 15/01* (2013.01)

(58) Field of Classification Search
CPC ..... F21V 15/01
See application file for complete search history.

(56) References Cited

U.S. PATENT DOCUMENTS

| | | | | |
|---|---|---|---|---|
| 6,231,346 | B1 * | 5/2001 | Sagi-Dolev | G09B 23/00 446/73 |
| D720,012 | S * | 12/2014 | Ishiwata | D19/181 |
| 9,890,938 | B2 * | 2/2018 | Zhang | F21V 14/00 |
| D968,679 | S * | 11/2022 | Yu | D26/104 |
| D975,912 | S * | 1/2023 | Zhou | D26/110 |
| 2007/0109813 | A1 * | 5/2007 | Copeland | H01R 35/04 362/641 |
| 2012/0257418 | A1 * | 10/2012 | Fields | F21S 8/035 362/641 |
| 2013/0223064 | A1 | 8/2013 | Lee et al. | |
| 2013/0229799 | A1 | 9/2013 | Lee et al. | |
| 2015/0153635 | A1 | 6/2015 | Chen et al. | |
| 2018/0017246 | A1 * | 1/2018 | Lau | F21V 14/065 |

* cited by examiner

*Primary Examiner* — Tsion Tumebo
(74) *Attorney, Agent, or Firm* — Zhigang Ma

(57) ABSTRACT

The present disclosures a projection lamp with quick locking and self-detection functions, and relates to the technical field of projection lamps. The projection lamp includes a body; an upper shell and a lower shell are arranged in the body; a connector is arranged between the upper shell and the lower shell; a light-emitting component is arranged in the upper shell and the lower shell; mounting frames are arranged on two sides of a bottom of the light-emitting component; and the projection lamp further includes a lower quick locking mechanism for connecting and fixing the lower shell to the light-emitting component, an upper locking mechanism for quickly connecting and fixing the upper shell to the light-emitting component, and an upper-shell and connector quick locking mechanism for quickly locking the upper shell to the connector.

7 Claims, 13 Drawing Sheets

PROJECTION LAMP WITH QUICK LOCKING AND SELF-DETECTION FUNCTIONS

TECHNICAL FIELD

The present disclosure relates to the technical field of projection lamps, and more particularly, to a projection lamp with quick locking and self-detection functions.

BACKGROUND

A projection lamp is a decorative lighting device that projects patterns on walls, ceilings, and lawns. It is used indoors, such as in a Karaoke TV (KTV) room, and outdoors, such as in a courtyard, on a lawn, and on plants, to create an atmosphere and decorate the landscape. Projection lamps have a very wide range of applications in daily life. A projection lamp is mainly composed of an upper shell, a lower shell, a light-emitting component, and a sound production component.

However, there are still some problems with the existing device during use. Due to the fact that the projection lamp is composed of multiple components, among which the light-emitting component is particularly important. The mounting of the light-emitting component directly affects a projection effect of the projection lamp. To mount the existing projection lamp, the light-emitting component is first mounted and fixed. The light-emitting component is provided with two groups of shells, and parts, such as various convex lenses and projection lamp transmitters, required for projection are placed inside the shells. The two groups of shells are connected and fixed in a screwed connection manner. In the process of achieving connection and fixing by screws, in order to increase the mounting speed, the shells are usually mounted by using electric screw drivers in the prior art. In this case, during mounting and connection using the electric screw driver, after there is a small-angle deviation between the two shells, the screws can also be mounted in place, so that a phenomenon that partial images are missing may occur during projection, causing the projection lamp to be defective. Furthermore, after the light-emitting component is mounted, the light-emitting component also needs to be mounted and connected to the upper and lower shells. After the mounting of the light-emitting component is completed, the upper and lower shells need to be mounted and connected. The mounting and connection here are usually achieved by the screws, so that there are a large number of screws on each projection lamp. It will take much time to fasten the screws, so that the production efficiency of the projection lamp is relatively low.

SUMMARY

The technical schemes of the present disclosure aim at the technical problem that the solution in the prior art is too simple, and provide a solution that is obviously different from that of the prior art. Embodiments of the present disclosure provide a projection lamp with quick locking and self-detection functions, so as to solve the technical problem that mounting and connection of a light-emitting component of an existing projection lamp are achieved by using a plurality of screws, so that the assembling speed is relatively low.

The embodiments of the present disclosure adopt the following technical schemes: A projection lamp with quick locking and self-detection functions includes a body, wherein an upper shell and a lower shell are arranged in the body; a connector is arranged between the upper shell and the lower shell; a light-emitting component is arranged in the upper shell and the lower shell; mounting frames are arranged on two sides of a bottom of the light-emitting component; a press limiting slot is formed in a top of the light-emitting component; a guide slot is formed in an inner surface of the connector; the projection lamp further includes a lower quick locking mechanism for connecting and fixing the lower shell to the light-emitting component, an upper locking mechanism for quickly connecting and fixing the upper shell to the light-emitting component, and an upper-shell and connector quick locking mechanism for quickly locking the upper shell to the connector; the lower quick locking mechanism includes two groups of connecting assemblies; each group of connecting assembly includes two first connecting rods; an elastic limiting block is arranged at an end portion of each first connecting rod; and a connecting frame is slidably arranged between the two first connecting rods.

Further, in an initial state, the connecting plate sleeves the elastic limiting block.

Further, the upper locking mechanism includes an upper positioning ring; the upper positioning ring is arranged at an inner top of the upper shell; a connecting slot is formed in the upper positioning ring; two groups of locking assemblies are arranged in the upper positioning ring; each group of locking assembly includes a second connecting block; the second connecting block is slidably connected to the connection slot; a sliding slot is formed in the second connecting block; a first connecting block is arranged in the sliding slot; a sliding block is arranged between the first connecting block and the sliding slot; a chute is arranged in the sliding slot; the chute is in cooperative connection with the sliding block; two positioning slots are formed in a lower surface of the first connecting block; only a connecting column is arranged in the first connecting block in a penetrating manner; a top end of the connecting column is connected to the upper positioning ring; a bottom end of the connecting column is connected to a press limiting block; a resisting plate is arranged at an end portion of the second connecting block; the second connecting block is provided with two elastic positioning blocks; and the elastic positioning blocks are used in cooperation with the positioning slots.

Further, the connecting column is slidably connected to the first connecting block; the resisting plate and the second connecting block have L-shaped cross sections; and a length of the resisting plate is greater than a length of the press limiting block.

Further, an upper surface of the press limiting block is in contact with a lower surface of the second connecting block; contact surfaces of the press limiting block and the second connecting block are slopes; and a bottom surface of the press limiting block is made of a soft material.

Further, the upper-shell and connector quick locking mechanism includes a connecting ring; a guide block is arranged on an outer surface of the connecting ring; the guide block is rotatably connected with a guide ring; several grooves are formed in the guide ring; a resisting block is arranged on one side of each groove, and a plugging block is arranged on the other side of the groove; the plugging block has an L-shaped cross section; and an elastic locking block is arranged in the plugging block.

Further, a second connecting rod is arranged at an inner bottom of the upper shell; a first positioning matching slot is formed in an outer side of the second connecting rod; a positioning block is arranged in the first positioning matching slot; the positioning block is connected to the connector; a wedge block is arranged at a bottom of the second connecting rod; and a second positioning matching slot is formed in the wedge block.

Further, contact surfaces of the wedge block and the resisting block are slopes.

Compared with the prior art, the present disclosure has the beneficial effects below:

First, in a use process, a mounting position of the light-emitting component can be quickly located through the lower quick locking mechanism, so that it is ensured that the light-emitting component can emit light normally in the subsequent mounting process. Furthermore, to connect the light-emitting component to the lower shell, only the mounting frames in the light-emitting component need to be aligned with the connecting rods, instead of performing the remaining steps. Moreover, the connecting rods are fixed on the lower shell, a distance between the connecting rods is fixed, so that during the connection of the light-emitting component to the lower shell, a secondary confirmation of whether a lower portion of the light-emitting component is mounted in place can be performed through the connecting rods, thus avoiding the phenomenon that improper mounting of the light-emitting component affects normal light emission.

Second, the light-emitting component and the upper shell can be locked and located quickly through the upper locking mechanism. After the light-emitting component and the lower shell have been mounted, the upper shell is mounted and connected. In the mounting and connecting process, only the upper shell is covered above the light-emitting component and is then pressed. Furthermore, positions of the components in the upper locking mechanism cannot be changed, so that during combination mounting of an upper portion of the light-emitting component, improper mounting of the upper portion causes a failure in normally combining and mounting the upper shell, so that the light-emitting component and the upper shell can be quickly connected and mounted through the upper locking mechanism, and a self-detection function can also be achieved on proper combination and mounting of the upper portion of the light-emitting component.

Third, after the light-emitting component and the upper shell have been mounted through the upper-shell and connector quick locking mechanism, the upper shell is continued to be pressed. In this case, the upper shell and the lower shell can be quickly mounted and connected under the action of the upper-shell and connector quick locking mechanism. During the connection of the existing body by screws, the screws need to be first placed in corresponding screw holes and are then tightened by a screwdriver. A skilled worker may spend about five seconds in completing the mounting of one screw, and it will take at least one minute to only connect and fix one projection lamp. The body of the present disclosure is quickly connected, so that only one action is usually performed to combine and mount the projection lamp, and the conventional method of connection and fixing by a plurality of screws is canceled. The action is simple, so that the production efficiency is greatly improved. The phenomenon of omitting to tighten a screw can be effectively avoided by only changing the connection method.

BRIEF DESCRIPTION OF THE DRAWINGS

To describe the specific implementation modes of the present disclosure or the technical solutions in the prior art more clearly, drawings required to be used in the specific implementation modes or the illustration of the prior art will be briefly introduced below. Apparently, the drawings in the illustration below are some implementation modes of the present disclosure. Those ordinarily skilled in the art can also obtain other drawings according to these drawings without doing creative work.

REFERENCE NUMERALS IN THE DRAWINGS

Figure 1:
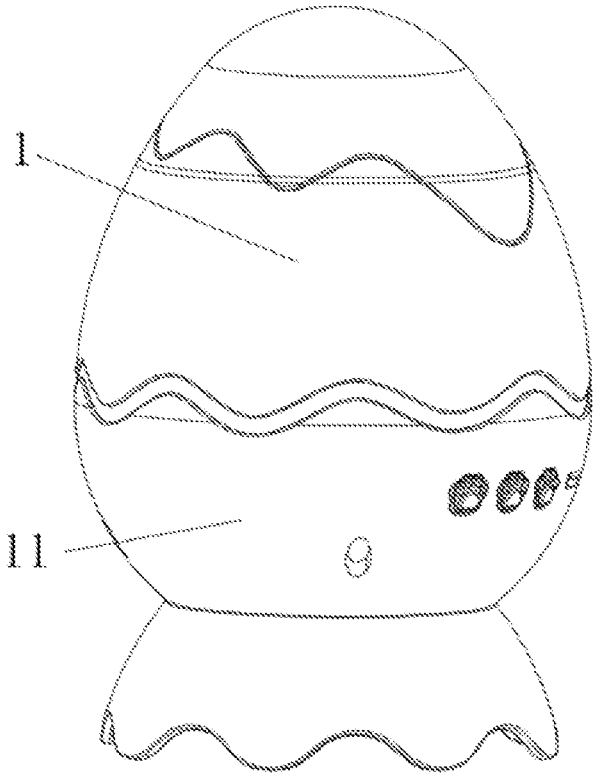
FIG. 1 is a schematic diagram of a main structure of the present disclosure.

1: body; 11: lower shell; 12: upper shell; 13: light-emitting component; 14: connector; 2: upper locking mechanism; 21: upper positioning ring; 22: sliding slot; 23: connecting column; 24: first connecting block; 25: positioning slot; 26: elastic positioning block; 27: press limiting block; 28: resisting plate; 29: second connecting block; 210: sliding block; 3: upper-shell and connector quick locking mechanism; 31: second connecting rod; 32: wedge block; 34: connecting ring; 35: resisting block; 36: plugging block; 37: first positioning matching slot; 38: positioning rod; 39: guide block; 310: guide slot; 311: elastic locking block; 312: second positioning matching slot; 4: lower quick locking mechanism; 41: first connecting rod; 42: connecting plate; and 43: elastic limiting block.

DETAILED DESCRIPTION OF THE EMBODIMENTS

The technical solutions of the present disclosure will be clearly and completely described below in conjunction with the accompanying drawings. Apparently, the described embodiments are only a part of the embodiments of the present disclosure, rather than all the embodiments.

The components of the embodiments of the present disclosure generally described and shown in the drawings here can be arranged and designed in a variety of different configurations. Therefore, the following detailed description for the embodiments of the present disclosure provided in the accompanying drawings is not intended to limit the scope of the claimed present disclosure, but merely represents selected embodiments of the present disclosure.

All other embodiments obtained by those of ordinary skill in the art based on the embodiments in the present disclosure without creative work shall fall within the protection scope of the present disclosure.

In the description of the present invention, it should be noted that orientations or positional relationships indicated by the terms "center", "upper", "lower", "left", "right", "vertical", "horizontal", "inside", "outside", and the like are orientations or positional relationships as shown in the drawings, and are only for the purpose of facilitating and simplifying the description of the present invention instead of indicating or implying that devices or elements indicated must have particular orientations, and be constructed and operated in the particular orientations, so that these terms are not construed as limiting the present invention. In addition, the terms "first", "second" and "third" are only for the purpose of description, and may not be understood as indicating or implying the relative importance.

In the description of the present invention, it should be also noted that unless otherwise explicitly defined and defined, the terms "mounted", "coupled" and "connected" shall be understood broadly, and may be, for example, fixedly connected, or detachably connected, or integrally connected, or mechanically connected, or electrically connected, or directly connected, or indirectly connected through an intermediate medium, or interconnection between two elements. Those of ordinary skill in the art can understand the specific meanings of the above terms in the present disclosure according to specific situations.

Figure 2:
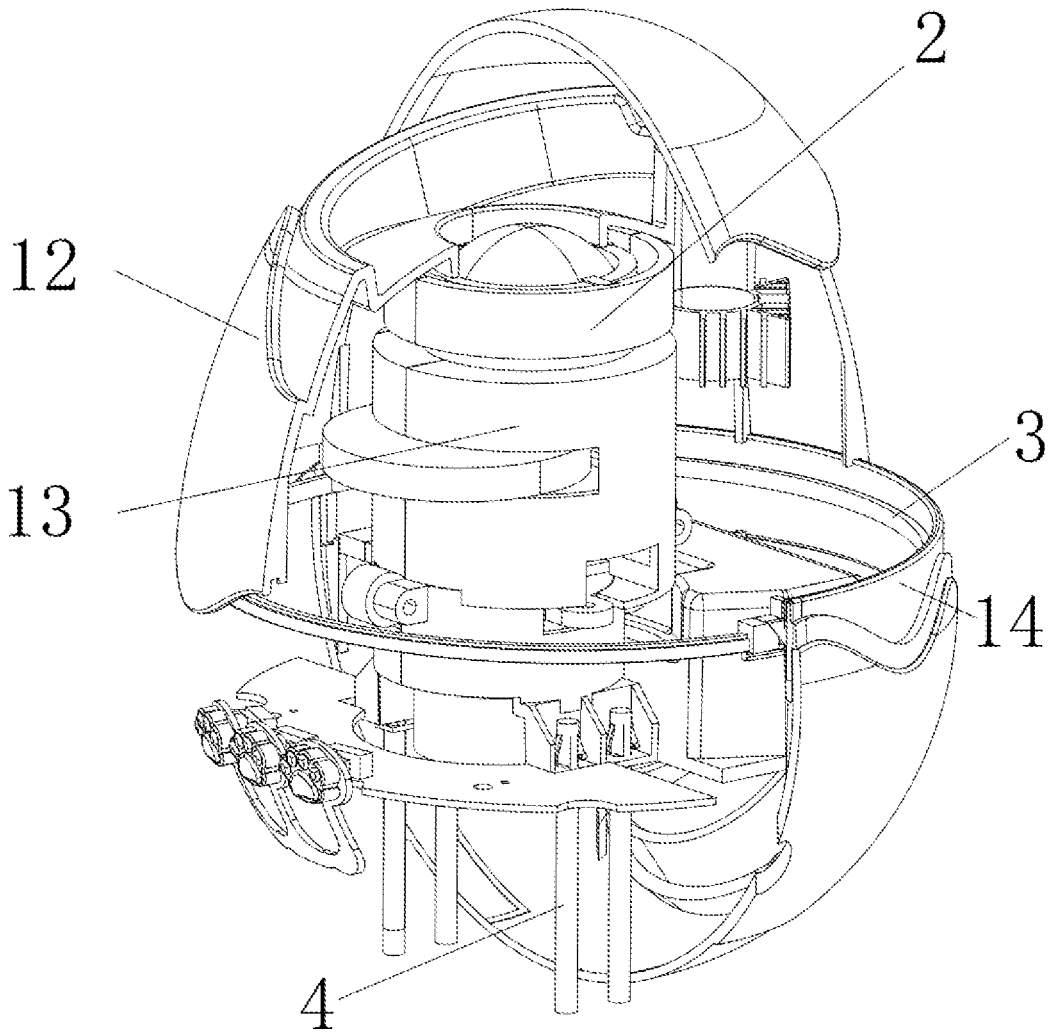
FIG. 2 is a schematic diagram of a main sectional structure of the present disclosure.
Figure 3:
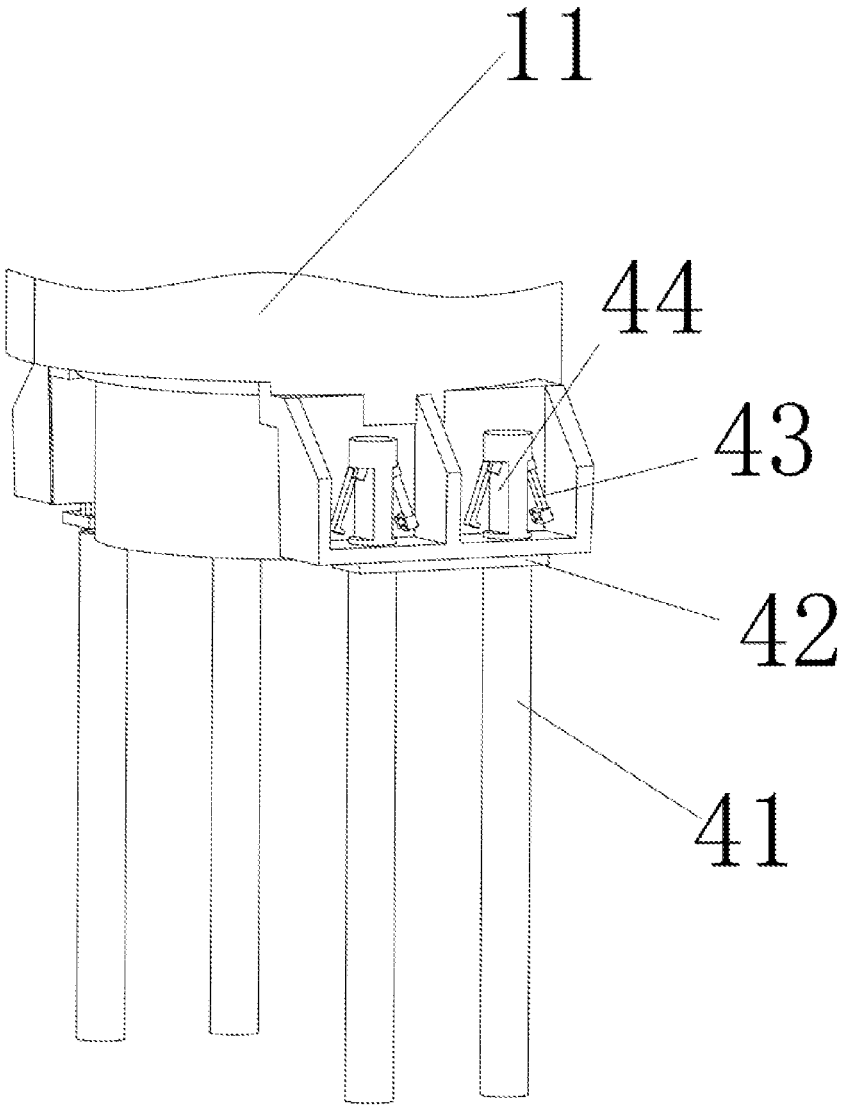
FIG. 3 is a schematic structural diagram of a working state of a lower quick locking mechanism of the present disclosure.
Figure 4:
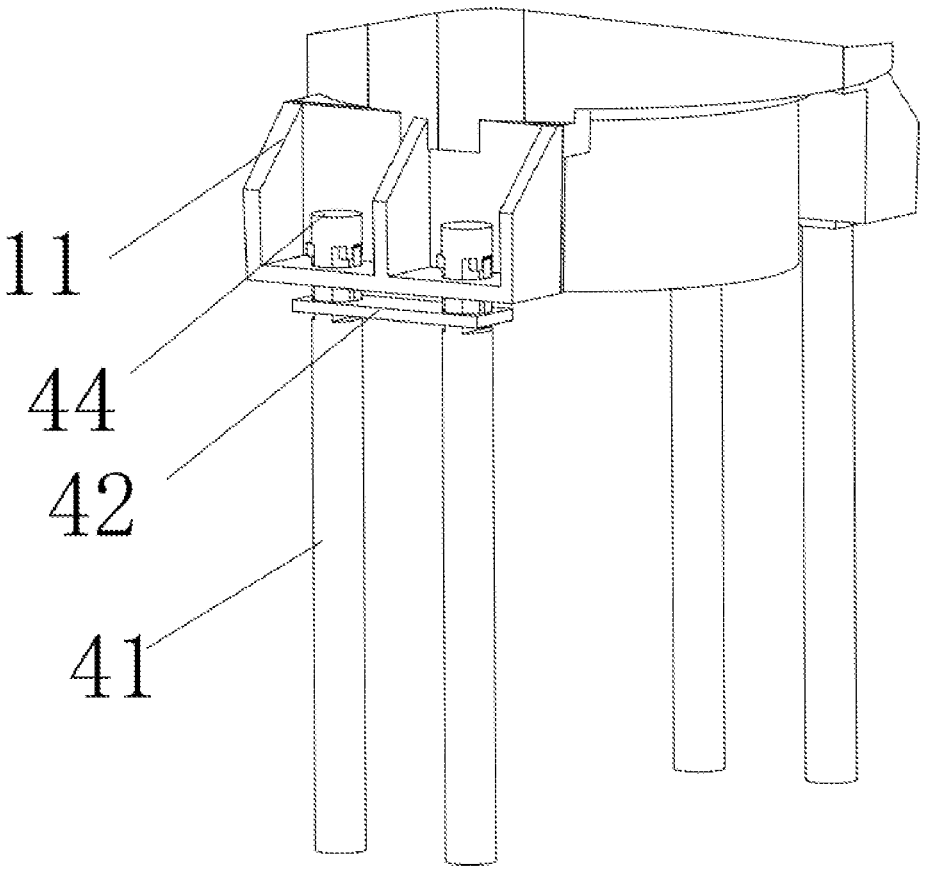
FIG. 4 is a schematic structural diagram of an initial state of a lower quick locking mechanism of the present disclosure.
Figure 5:
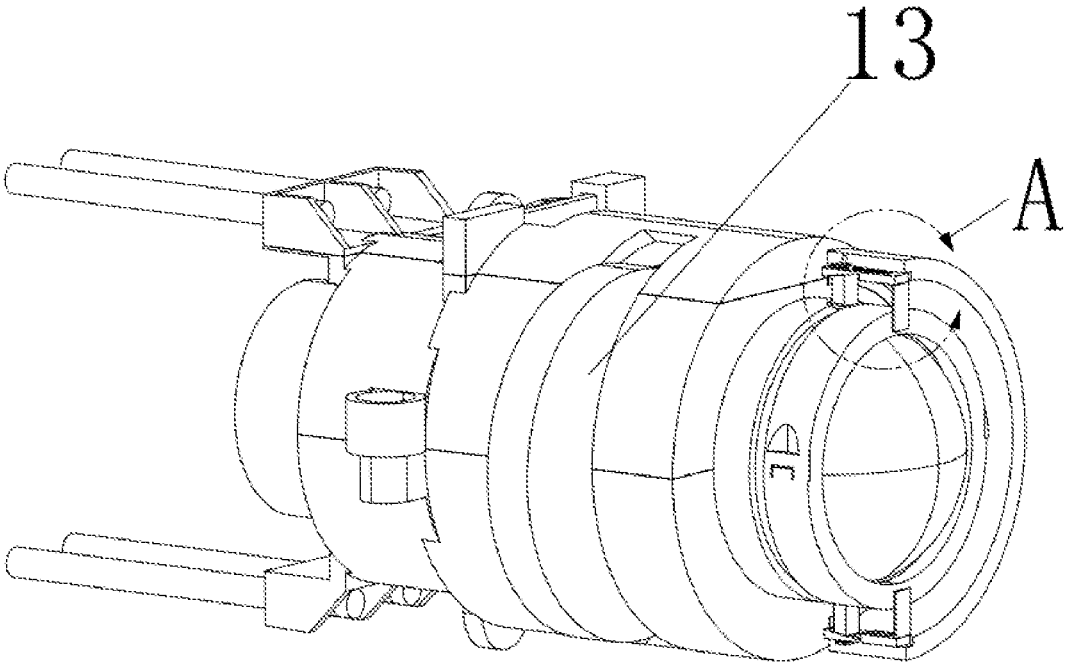
FIG. 5 is a schematic structural diagram of connection between a light-emitting component and an upper locking mechanism of the present disclosure.
Figure 6:
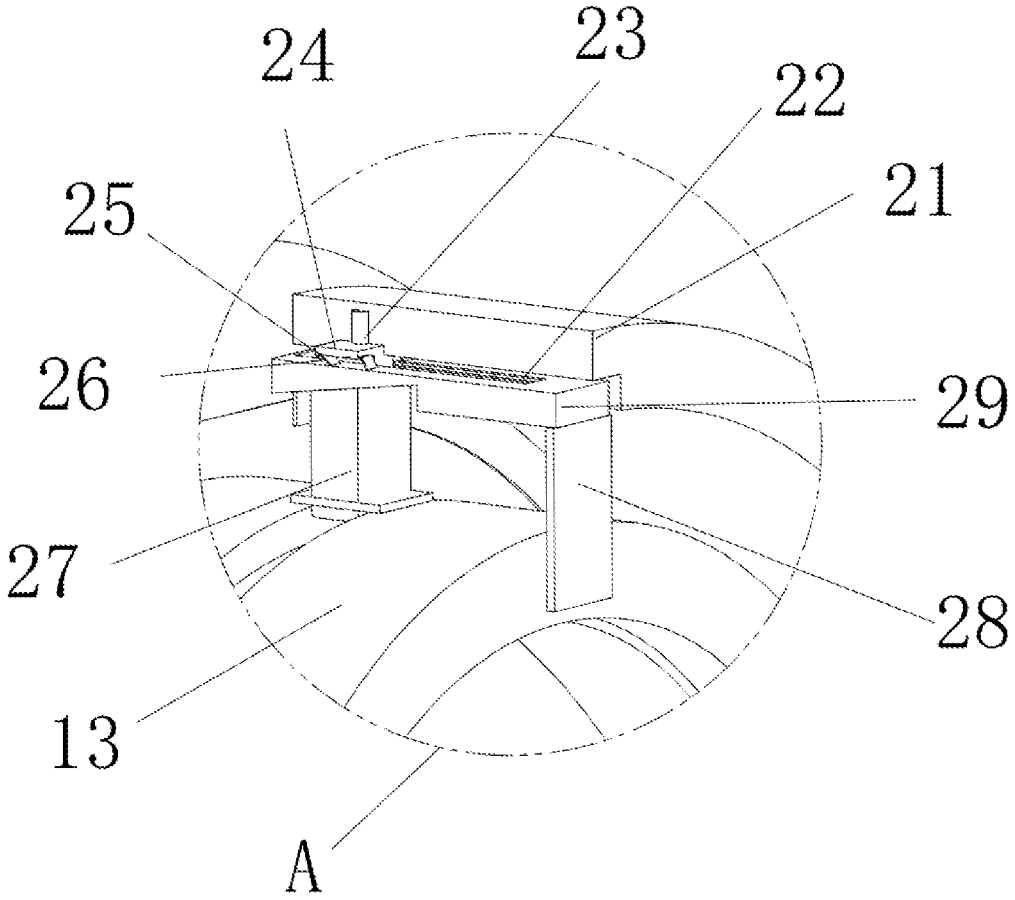
FIG. 6 is a schematic diagram of an enlarged structure of the portion A of the present disclosure in FIG. 5.
Figure 7:
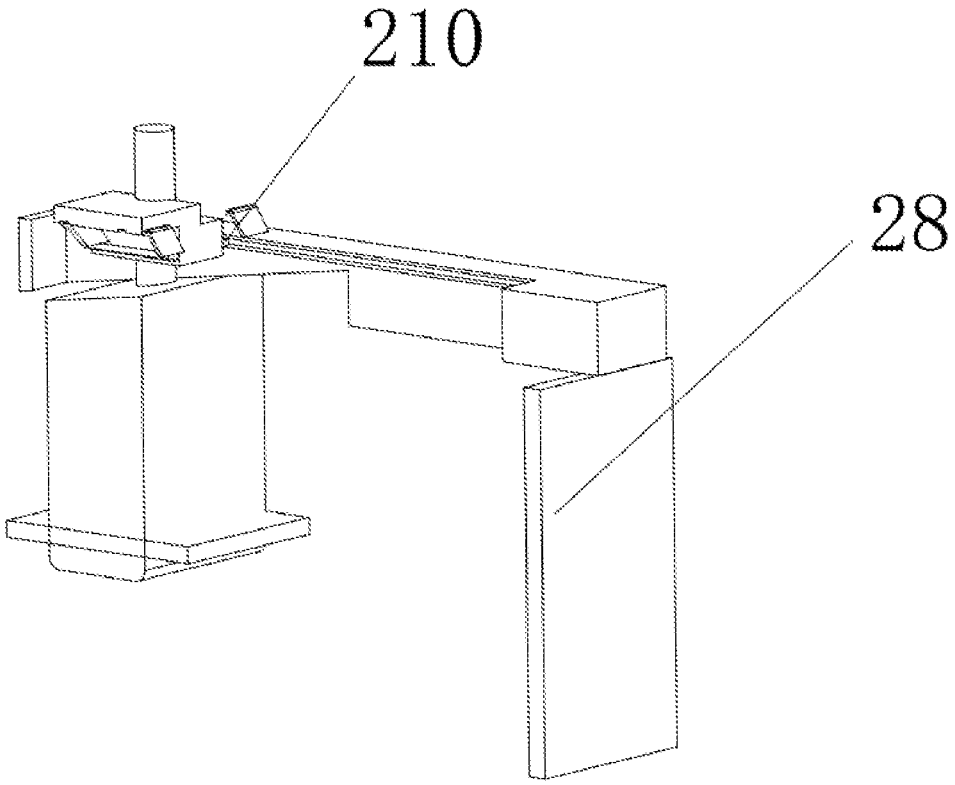
FIG. 7 is a schematic diagram of a sectional structure of a second connection block of the present disclosure.
Figure 8:
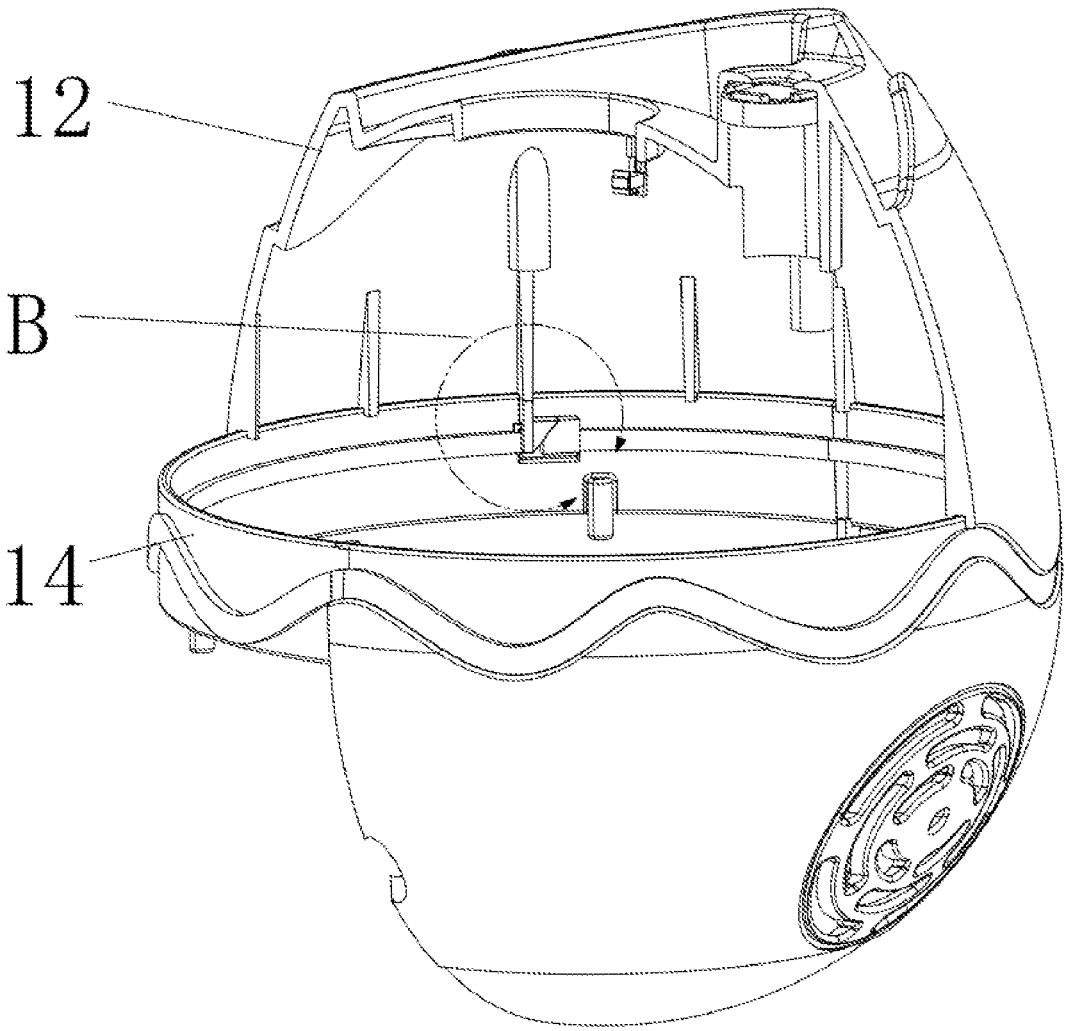
FIG. 8 is a schematic structural diagram of an upper-shell and connector quick locking mechanism of the present disclosure.
Figure 9:
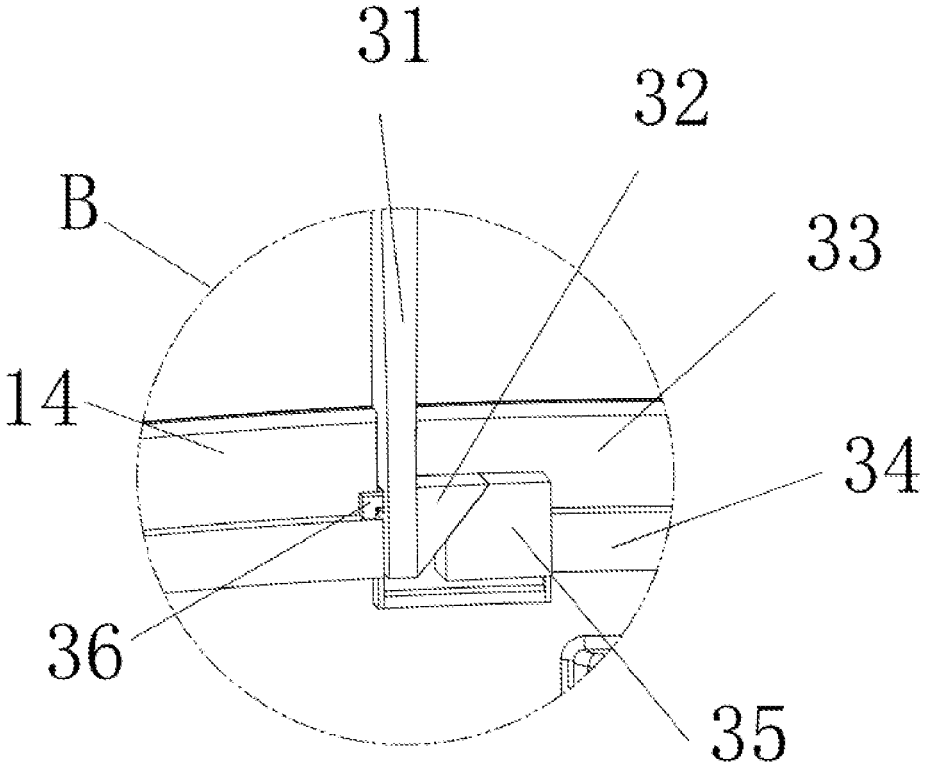
FIG. 9 is a schematic diagram of an enlarged structure of the portion B of the present disclosure in FIG. 8.
Figure 10:
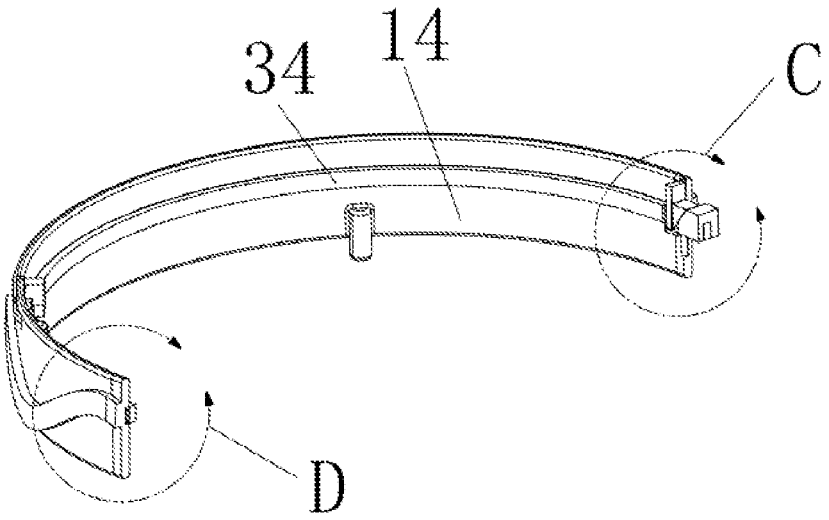
FIG. 10 is a schematic diagram of a sectional structure of an upper-shell and connector quick locking mechanism of the present disclosure.
Figure 11:
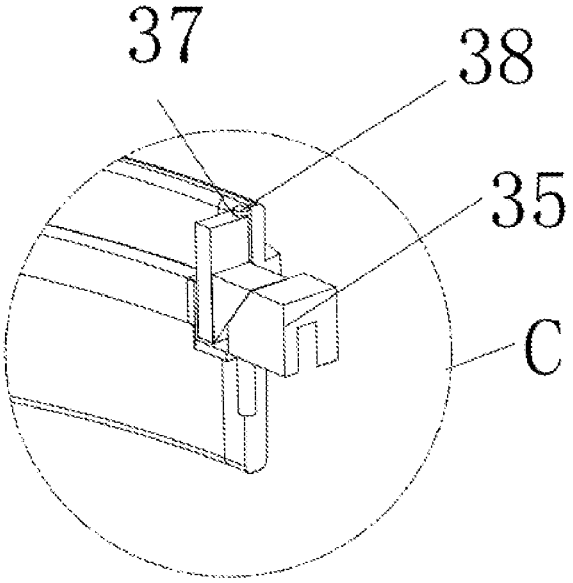
FIG. 11 is a schematic diagram of an enlarged structure of the portion C of the present disclosure in FIG. 10.
Figure 12:
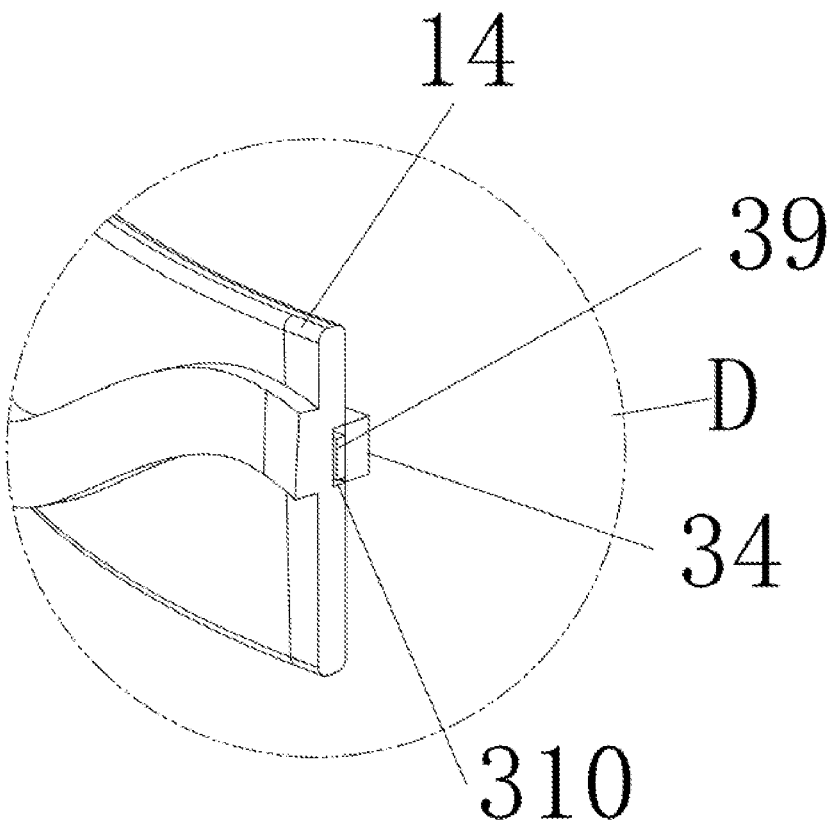
FIG. 12 is a schematic diagram of an enlarged structure of the portion D of the present disclosure in FIG. 10.
Figure 13:
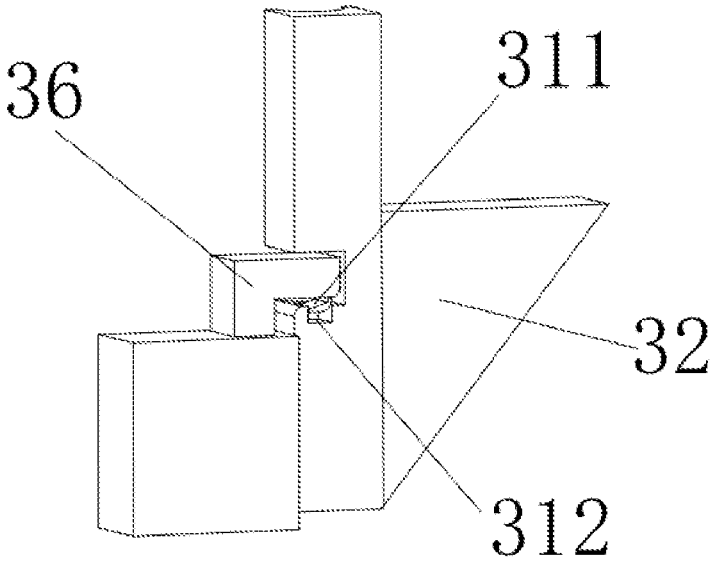
FIG. 13 is a schematic diagram of sectional structures of a connecting rod and a wedge block of the present disclosure.

As shown in FIG. 1 to FIG. 13 below, embodiments of the present disclosure provide a projection lamp with quick locking and self-detection functions, including a body 1, wherein an upper shell 12 and a lower shell 11 are arranged in the body 1; a connector 14 is arranged between the upper shell 12 and the lower shell 11; a light-emitting component 13 is arranged in the upper shell 12 and the lower shell 11; mounting frames are arranged on two sides of a bottom of the light-emitting component 13; a press limiting slot is formed in a top of the light-emitting component 13; a guide slot 310 is formed in an inner surface of the connector; the projection lamp further includes a lower quick locking mechanism 4 for connecting and fixing the lower shell 11 to the light-emitting component 13, an upper locking mechanism 2 for quickly connecting and fixing the upper shell 12 to the light-emitting component 13, and an upper-shell and connector quick locking mechanism 3 for quickly locking the upper shell 12 to the connector 14; the lower quick locking mechanism 4 includes two groups of connecting assemblies; each group of connecting assembly includes two first connecting rods 41; an elastic limiting block 43 is arranged at an end portion of each first connecting rod 41; and a connecting frame is slidably arranged between the two first connecting rods.

During working, the light-emitting component 13 and the upper shell 12 can be quickly connected and fixed through the upper locking mechanism 2; the light-emitting component 13 and the lower shell 11 can be quickly connected and fixed through the lower quick locking mechanism 4; and the upper shell 12 and the lower shell 11 can be connected and fixed through the upper-shell and connector quick locking mechanism 3. Furthermore, the connecting and fixing processes can be completed by only one pressing action, which greatly simplifies the operation step, thereby effectively improving the working efficiency. In addition, the light-emitting component 13 can also be detected in the connecting and mounting processes to ensure that the light-emitting component 13 is mounted in place.

Specifically, in an initial state, the connecting plate 42 sleeves the elastic limiting block 43.

During working, the elastic limiting block 43 is pressed in the initial stage, which is convenient for mounting.

Specifically, the upper locking mechanism 2 includes an upper positioning ring 21; the upper positioning ring 21 is arranged at an inner top of the upper shell 12; a connecting slot is formed in the upper positioning ring 21; two groups of locking assemblies are arranged in the upper positioning ring 21; each group of locking assembly includes a second connecting block 29; the second connecting block 29 is slidably connected to the connection slot; a sliding slot 22 is formed in the second connecting block 29; a first connecting block 24 is arranged in the sliding slot 22; a sliding block 210 is arranged between the first connecting block 24 and the sliding slot 22; a chute is arranged in the sliding slot 22; the chute is in cooperative connection with the sliding block 210; two positioning slots 25 are formed in a lower surface of the first connecting block 24; only a connecting column 23 is arranged in the first connecting block 24 in a penetrating manner; a top end of the connecting column 23 is connected to the upper positioning ring 21; a bottom end of the connecting column 23 is connected to a press limiting block 27; a resisting plate 28 is arranged at an end portion of the second connecting block 29; two positioning slots 25 are formed in a lower surface of the first connecting block 24; the second connecting block 29 is provided with two elastic positioning blocks 26; and the elastic positioning blocks 26 are used in cooperation with the positioning slots 25.

Specifically, the connecting column 23 is slidably connected to the first connecting block 24; the resisting plate 28 and the second connecting block 29 have L-shaped cross sections; and a length of the resisting plate 28 is greater than a length of the press limiting block 27.

During working, when the light-emitting component 13 is connected to the upper locking mechanism 2, the light-emitting component 13 may resist against the press limiting block 27, so that the upper locking mechanism 2 works.

Specifically, an upper surface of the press limiting block 27 is in contact with a lower surface of the second connecting block 29; contact surfaces of the press limiting block 27 and the second connecting block 29 are slopes; and a bottom surface of the press limiting block 27 is made of a soft material.

During working, the contact surfaces of the press limiting block 27 and the second connecting block 29 are the slopes, so that the second connecting block 29 may move to drive the press limiting block 27 to move. At the same time, the bottom surface is convenient for movement because of the soft material. The position of the press limiting slot is constant, so that the press limiting slot can just overlap the press limiting block 27 only when the light-emitting component 13 moves to a certain position. If the press limiting block 27 also enters the press limiting slot, the movement of the light-emitting component 13 will be greatly resisted. In this case, it indicates that the upper portion of the light-emitting component 13 is not mounted in place.

Specifically, the upper-shell and connector quick locking mechanism 3 includes a connecting ring 34; a guide block 39 is arranged on an outer surface of the connecting ring 34; the guide block 39 is rotatably connected with a guide ring; several grooves are formed in the guide ring; a resisting block 35 is arranged on one side of each groove, and a plugging block 36 is arranged on the other side of the groove; the plugging block 36 has an L-shaped cross section; and an elastic locking block 311 is arranged in the plugging block 36.

Specifically, a second connecting rod 31 is arranged at an inner bottom of the upper shell 12; a first positioning matching slot 37 is formed in an outer side of the second connecting rod 31; a positioning block is arranged in the first positioning matching slot 37; the positioning block is connected to the connector; a wedge block 32 is arranged at a bottom of the second connecting rod 31; and a second positioning matching slot 312 is formed in the wedge block 32.

Specifically, contact surfaces of the wedge block 32 and the resisting block 35 are slopes.

A working principle is as follows: During use, the light-emitting component 13 needing to be mounted is first placed in the lower shell 11. Through slots are formed in the mounting frames. The positions of the through slots correspond to the first connecting rods 41. The light-emitting component 13 is then pressed. In the process that the light-emitting component 13 moves downwards, the connecting plate 42 may be driven to synchronously move downwards. After the connecting plate 42 moves to a certain position, the connecting plate 42 cannot continue to move downwards. In this case, the elastic limiting block 43 may be opened to be clamped to an upper surface of the connecting frame. At this time, the elastic limiting block 43 cooperates with the connecting plate 42 to complete connection and fixing between the light-emitting component 13 and the lower shell 11. The upper shell 12 is then clamped at the top of the light-emitting component 13. In the clamping process, the positioning slot 25 formed in the second connecting rod 31 in the upper shell 12 is aligned with the positioning rod 38 in the connector 14, and the top of the light-emitting component 13 is located in the upper positioning ring 21. The upper shell 12 is then pressed. In the continuous pressing process, the top of the light-emitting component 13 may resist against the resisting plate 28. The resisting plate 28 drives the second connecting block 29 to move under the action of a force. In the moving process of the second connecting block 29, the press limiting block 27 is connected to the upper positioning ring 21 through the connecting column 23, and the connecting column 23 adopts an elastic telescopic rod, so that the cooperation with the slope of the press limiting block 27 causes the press limiting block 27 to move downwards. After moving to a certain position, the press limiting block 27 may be clamped into the press limiting slot. In the moving process, the initial elastic positioning block 26 may move out of the positioning slot 25. After the press limiting block 27 moves to the final position, the second elastic positioning block 26 may be clamped into the corresponding positioning slot 25. In addition, in the pressing process, the second connecting rod 31 moves downwards to drive the wedge block 32 to move downwards, and the wedge block 32 moves downwards to resist against the resisting block 35, so that the resisting block 35 moves to drive the connecting ring 34 to rotate around the connector 14. After the connecting ring rotates to a certain position, the plugging block 36 may be plugged into the second connecting rod 31. After the plugging reaches a certain depth, the elastic locking block 311 arranged on the plugging block 36 is opened to be clamped into the positioning slots 25, so that in the process of fixing the upper shell 12 to the upper portion of the light-emitting component 13, the upper shell 12 and the lower shell 11 are also synchronously positioned and fixed.

In summary, in the processes of connecting and fixing the light-emitting component 13 to the upper shell 12 and the lower shell 11, only one pressing action is performed, so that the operation step is effectively simplified. Furthermore, in the connecting and fixing processes, the mounted light-emitting component 13 can also be detected, so as to avoid the influence of the improper mounting of the light-emitting component 13 on subsequent use.

It should be finally noted that the above various embodiments are only used to describe the technical solutions of the present disclosure, and not intended to limit the present disclosure. Although the present disclosure has been described in detail with reference to the foregoing embodiments, those ordinarily skilled in the art should understand that they can still modify the technical solutions described in all the foregoing embodiments, or equivalently replace some or all of the technical features, and these modifications or replacements do not depart the essences of the corresponding technical solutions from the scope of the technical solutions of all the embodiments of the present disclosure.

What is claimed is:

1. A projection lamp with quick locking and self-detection functions, comprising a body (1), wherein an upper shell (12) and a lower shell (11) are arranged in the body (1); a connector (14) is arranged between the upper shell (12) and the lower shell (11); a light-emitting component (13) is arranged in the upper shell (12) and the lower shell (11); mounting frames are arranged on two sides of a bottom of the light-emitting component (13); a press limiting slot is formed in a top of the light-emitting component (13); a guide slot (310) is formed in an inner surface of the connector; the projection lamp further comprises a lower quick locking mechanism (4) for connecting and fixing the lower shell (11) to the light-emitting component (13), an upper locking mechanism (2) for quickly connecting and fixing the upper shell (12) to the light-emitting component (13), and an upper-shell and connector quick locking mechanism (3) for quickly locking the upper shell (12) to the connector (14); the lower quick locking mechanism (4) comprises two groups of connecting assemblies; each group of connecting assembly comprises two first connecting rods (41); an elastic limiting block (43) is arranged at an end portion of each first connecting rod (41); and a connecting frame is slidably arranged between the two first connecting rods (41).

2. The projection lamp with the quick locking and self-detection functions according to claim 1, wherein the upper locking mechanism (2) comprises an upper positioning ring (21); the upper positioning ring (21) is arranged at an inner top of the upper shell (12); a connecting slot is formed in the upper positioning ring (21); two groups of locking assemblies are arranged in the upper positioning ring (21); each group of locking assembly comprises a second connecting block (29); the second connecting block (29) is slidably connected to the connection slot; a sliding slot (22) is formed in the second connecting block (29); a first connecting block (24) is arranged in the sliding slot (22); a sliding block (210) is arranged between the first connecting block (24) and the sliding slot (22); a chute is arranged in the sliding slot (22); the chute is in cooperative connection with the sliding block (210); two positioning slots (25) are formed in a lower surface of the first connecting block (24); only a connecting column (23) is arranged in the first connecting block (24) in a penetrating manner; a top end of the connecting column (23) is connected to the upper positioning ring (21); a bottom end of the connecting column (23) is connected to a press limiting block (27); a resisting plate (28) is arranged at an end portion of the second connecting block (29); two positioning slots (25) are formed in a lower surface of the first connecting block (24); the second connecting block (29) is provided with two elastic positioning blocks (26); and the elastic positioning blocks (26) are used in cooperation with the positioning slots (25).

3. The projection lamp with the quick locking and self-detection functions according to claim 2, wherein the connecting column (23) is slidably connected to the first connecting block (24); the resisting plate (28) and the second connecting block (29) have L-shaped cross sections; and a length of the resisting plate (28) is greater than a length of the press limiting block (27).

4. The projection lamp with the quick locking and self-detection functions according to claim 2, wherein an upper surface of the press limiting block (27) is in contact with a lower surface of the second connecting block (29); contact surfaces of the press limiting block (27) and the second connecting block (29) are slopes; and a bottom surface of the press limiting block (27) is made of a soft material.

5. The projection lamp with the quick locking and self-detection functions according to claim 1, wherein the upper-shell and connector quick locking mechanism (3) comprises a connecting ring (34); a guide block (39) is arranged on an outer surface of the connecting ring (34); the guide block (39) is rotatably connected with a guide ring; several grooves are formed in the guide ring; a resisting block (35) is arranged on one side of each groove, and a plugging block (36) is arranged on the other side of the groove; the plugging block (36) has an L-shaped cross section; and an elastic locking block (311) is arranged in the plugging block (36).

6. The projection lamp with the quick locking and self-detection functions according to claim 1, wherein a second connecting rod (31) is arranged at an inner bottom of the upper shell (12); a first positioning matching slot (37) is formed in an outer side of the second connecting rod (31); a positioning block is arranged in the first positioning matching slot (37); the positioning block is connected to the connector; a wedge block (32) is arranged at a bottom of the second connecting rod (31); and a second positioning matching slot (312) is formed in the wedge block (32).

7. The projection lamp with the quick locking and self-detection functions according to claim 6, wherein contact surfaces of the wedge block (32) and the resisting block (35) are slopes.

* * * * *